US006996927B2

(12) United States Patent
Meidinger

(10) Patent No.: US 6,996,927 B2
(45) Date of Patent: Feb. 14, 2006

(54) BASEBALL THEME DISPLAY DEVICE

(76) Inventor: James Meidinger, 215½ 2N. Navarra, Scotts Valley, CA (US) 95066

( * ) Notice: Subject to any disclaimer, the term of this patent is extended or adjusted under 35 U.S.C. 154(b) by 0 days.

(21) Appl. No.: 10/267,998

(22) Filed: Oct. 8, 2002

(65) Prior Publication Data

US 2004/0064981 A1 Apr. 8, 2004

(51) Int. Cl.
*G09F 11/00* (2006.01)

(52) U.S. Cl. ..... 40/1; 211/163

(58) Field of Classification Search ..... 40/1, 40/124, 493, 538; 211/33, 163, 205; 428/542.4; 473/564; D6/303, 412, 552
See application file for complete search history.

(56) References Cited

U.S. PATENT DOCUMENTS

| | | | | | |
|---|---|---|---|---|---|
| 2,010,093 | A | * | 8/1935 | Lazarus | 211/30 |
| 2,692,689 | A | * | 10/1954 | Wynne, Sr. | 211/165 |
| D192,547 | S | * | 4/1962 | Kellogg | D6/460 |
| 3,035,362 | A | * | 5/1962 | Kweskin | 40/124 |
| 3,635,352 | A | * | 1/1972 | Brooks et al. | 211/47 |
| D233,500 | S | * | 11/1974 | Phillips | D6/303 |
| D285,393 | S | * | 9/1986 | Miller | D6/412 |
| 4,889,246 | A | * | 12/1989 | Lee | 211/163 |
| D324,793 | S | * | 3/1992 | Johnson | D6/552 |
| D326,964 | S | * | 6/1992 | Kakuk et al. | D6/412 |
| 5,190,829 | A | | 3/1993 | Nybye | |
| D363,184 | S | | 10/1995 | Elhage | |
| 5,678,698 | A | | 10/1997 | Cabral | |
| D390,737 | S | * | 2/1998 | Strnad | D6/552 |
| D397,885 | S | | 9/1998 | Reed | |
| 5,890,308 | A | | 4/1999 | Harrington | |
| 6,009,653 | A | | 1/2000 | Harrington | |
| D436,134 | S | | 1/2001 | Aguayo, Jr. | |
| 6,425,490 | B1 | * | 7/2002 | Ta | 211/116 |
| 6,568,546 | B1 | * | 5/2003 | Huang | 211/205 |

OTHER PUBLICATIONS

"Dictonary.com" definition for "slat", http://dictionary.reference.com/search48 q=slat, Aug. 11, 2004.*

* cited by examiner

*Primary Examiner*—Andrew D. Wright
(74) *Attorney, Agent, or Firm*—Morrison & Foerster LLP

(57) ABSTRACT

This is a display device made from a baseball bat that has been cut into sections, spools, and slats. The spools and slats are re-assembled in such a way that the fact that the display device is constructed from baseball bat parts is not lost on the casual observer.

24 Claims, 3 Drawing Sheets

BASEBALL THEME DISPLAY DEVICE

FIELD OF THE INVENTION

This invention is a display device. In particular, it is a device made from a baseball bat that has been cut into sections, e.g., spools and slats, and reassembled so that the longer sections, the slats, support whatever might be displayed and the remaining sections, the spools, separate the slats and allow them to fan out from a central axis. The display is assembled in such a way that the fact that it is constructed from baseball bat parts is not lost on the casual observer.

BACKGROUND OF THE INVENTION

There are a significant number of display devices having a baseball theme of some kind.

U.S. Pat. No. 5,190,829, to Nybye, discloses a wooden baseball bat having a section that is cut away, carved into an ornamental arrangement, and then rejoined to the baseball bat. Similarly, U.S. Pat. Nos. 5,890,308 and 6,009,653, to Harrington, both show display devices designed to appear similar to a baseball bat, but are used as supports for displaying graphic materials. The devices shown in the two Harrington patents are not revised baseball bats.

U.S. Design Pat. Nos. D436,134 (to Aguamo Jr.); D397,885 (to Reed); and D363,184 (to Elhagy) depict display cases having a baseball theme. They variously are for the purpose of displaying baseballs, bats, or cards.

U.S. Pat. No. 5,678,698, to Cabral, shows a baseball bat rack for baseball hats and related articles. It is a display device used for hats, gloves, and the like. It is made from a baseball bat mounted on its end in a base. The display includes a number of pegs that are extendable through the bat's body, but, in any event, are used for hanging the baseball paraphernalia.

None of the cited documents show a display device of the type described and claimed here.

SUMMARY OF THE INVENTION

This invention is a display device. In general, it is made from a wooden baseball bat. The larger or barrel end of the bat is separated, perhaps by sawing, into a number of long slats. The handle end of the bat is cut into a number of spool-like pieces each generally having a common, lengthwise or longitudinal passageway. The slats cut from the barrel end of the bat are typically mounted between the spool pieces at their small ends. Those small ends of the slats are drilled with a hole, that when lined up with the holes in the spool pieces form a longitudinal passageway so that a long fastener, such as a bolt or the like, may be passed through the holes to hold the device together. Under certain circumstances, the device may be glued together, if so desired. Small flat supports or bases (for the displayed baseball or whatever) may be affixed at or near the large ends of the slats. These supports may be painted to depict baseballs. The device may have mounting sites on the back to allow it's hanging from a wall or it may be mounted upon a separate base.

DESCRIPTION OF THE INVENTION

This invention is a display device. Specifically, it is a device made from a baseball bat, typically wooden, and might be used to display baseball memorabilia, such as autographed baseballs or the like. It may be configured to be hung from a wall or attached to a stand. The display device typically includes a number of slats, cut from the barrel end of the bat, that are splayed from a central column. The central column, in turn, is constructed from sections cut from the handle end of the bat. In most variations, the slats may be rotated about that central column.

Generally, this device is constructed of parts or slats sawed from a standard wooden baseball bat. Most wooden bats are made from ash, a sturdy and resilient wood, although many are constructed of maple wood.

Figure 1:
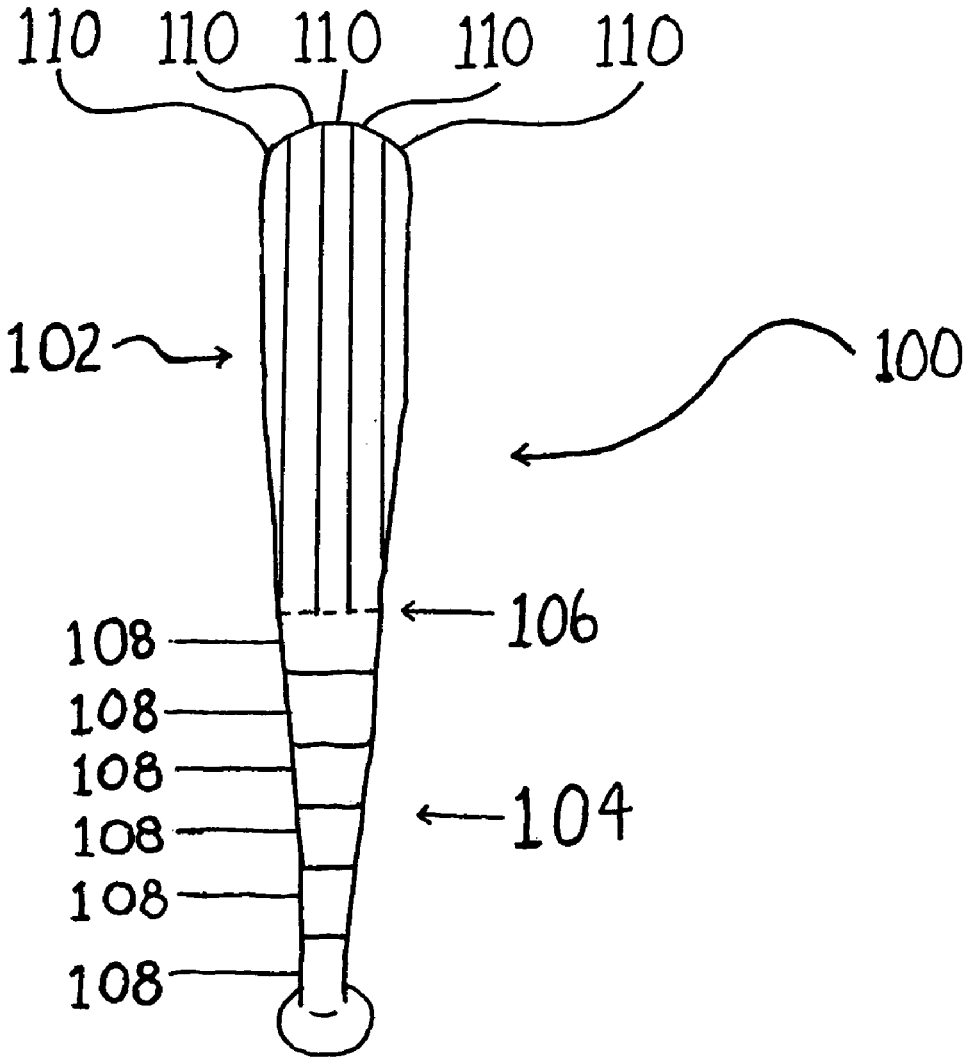
FIG. 1 depicts a baseball bat as it would be cut to make the various portions of the display device.

FIG. 1 shows a desirable way to cut a bat (100) for the parts used in assembling the display. The bat (100) has a barrel end (102) and a handle end (104), also known as a butt end.

The handle end (104) of the bat (100) is first provided with a central bore (shown in FIG. 2) and then cut (106). The handle end (104) is then cut or sawed into a number of spool pieces (108). The number of spool pieces (108) is generally selected to complement the number of slats (110) cut from the barrel end (102).

Figure 2:
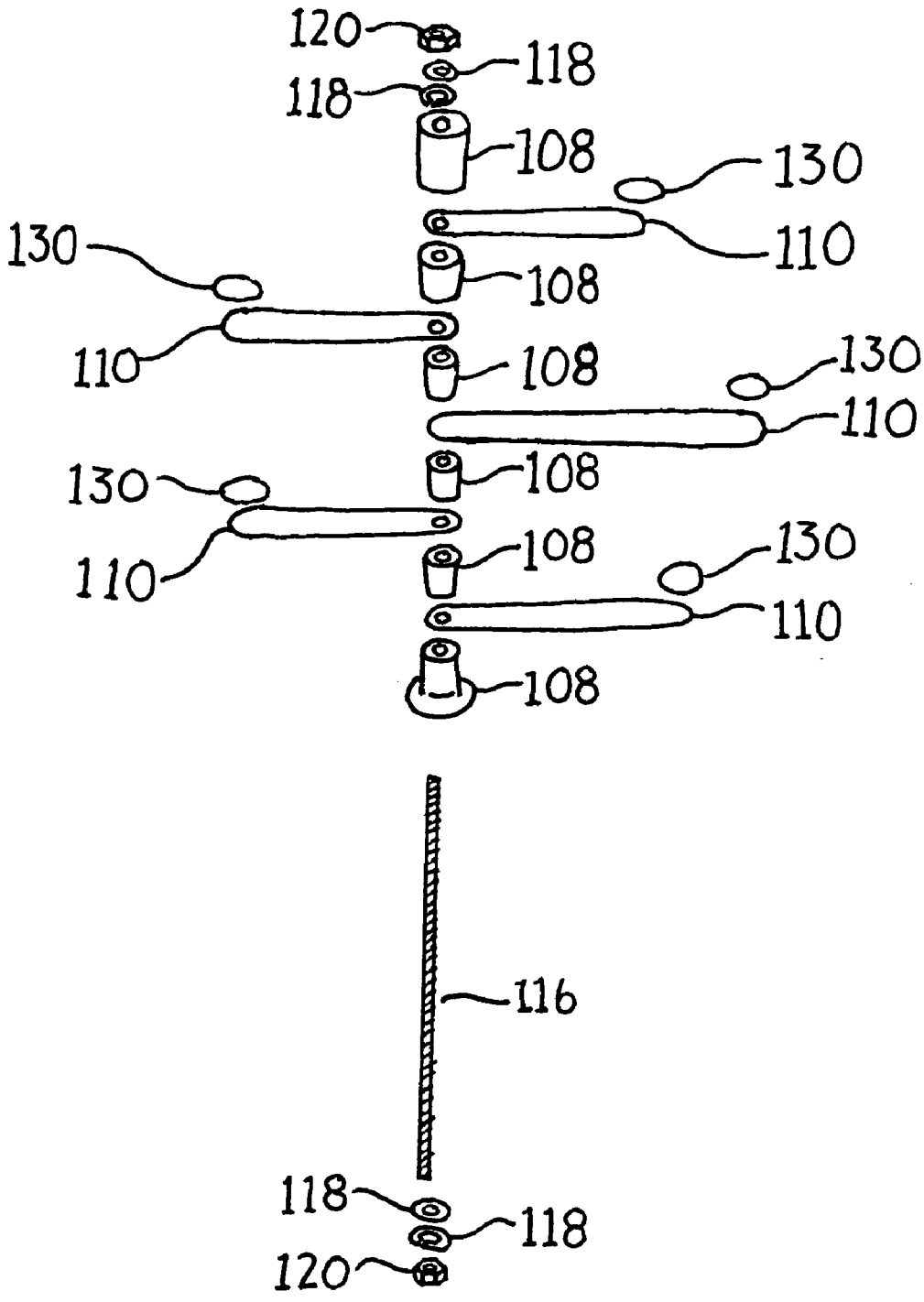
FIG. 2 is an exploded drawing of the display device.

FIG. 2 is an exploded drawing of the device showing slats (110) each having an opening (112) at the smaller end situated between the variation spool pieces (108) cut from the bat (100) and with a lower terminating spool piece (114) made from the very butt end of the bat. As is shown in FIG. 2, each of the spool pieces also has longitudinal passageway cut or drilled through the various pieces. Although the inventive display may be glued together, this variation shown in the Figures has a long threaded center piece (116) (an "Allthread") and washers (118) at the top and bottom and secured by a nut (120) or other similar fastener at each end.

Figure 3:
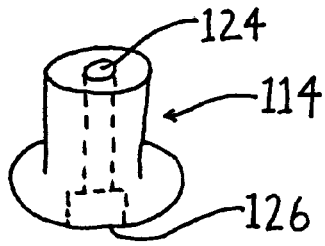
FIG. 3 is a side view of the end spool pieces at the handle end of the display.
Figure 5:
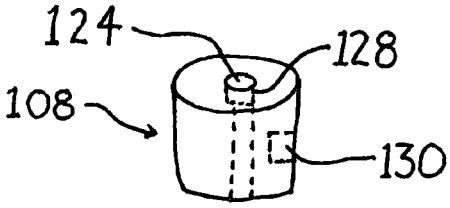
FIG. 5 shows a perspective view of the upper most spool piece.

FIG. 3 shows the endmost spool piece (114) having a passageway (124). At the bottom end of passageway (124) may be seen in shadow, an inset (126) for placement or recess of the bottom nut (120) as shown in FIG. 2. Similarly, FIG. 5 shows the uppermost spool piece (108) with passageway (124) and inset (128) in which to site the washers and nut. It should be apparent that one of the washers may be a lock washer to help the nuts stay fastened within the device.

Figure 4:
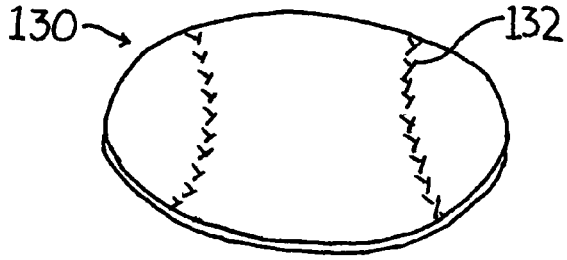
FIG. 4 is a perspective view of a representative display support.

FIG. 4 shows a support (130) that may be situated on and glued to the end of slats (110) as shown in FIG. 3. The support (130) may be circular and painted in a baseball motif with threads (132) being shown. Thin material such as pressboard or Masonite may be suitable for support (130).

Figure 6:
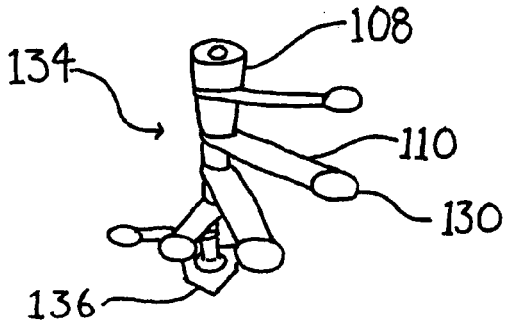
FIG. 6 shows the inventive device and perspective mounted upon a base.

FIG. 6 shows an assembled device (134) with spool pieces (108), slats (110), and supports (130) all mounted on a support (136). The device (134) may either be mounted on a support as shown in FIG. 6, or optionally hung from mounting hole (138) as shown in FIG. 5.

I claim as my invention:

1. A baseball theme display device comprising:

a wooden baseball bat having a barrel end and a narrower handle end, a plurality of slats sawed longitudinally from the wooden baseball bat, each slat having a barrel end and a handle end corresponding to the barrel end and the handle end of the wooden baseball bat, each slat having a hole located in the handle end, a plurality of spool pieces with longitudinal passageways sawed from the handle end of the wooden baseball bat, and a longitudinal assembly rod, wherein the display is configured so that the assembly rod passes alternately through the holes in the slats and the longitudinal passageways in the spool pieces, such that the slats are separated from each on such assembly rod by a spool piece.

2. The display device of claim 1 where the assembly rod is threaded and further comprising fasteners configured to hold the display device together.

3. The display device of claim 1 where the slats are rotatable about the assembly rod and about the holes in the handle end of the slats.

4. The display device of claim 1 further comprising at least one opening adapted to allow the display device to be hung.

5. The display device of claim 1 further comprising substantially circular display surfaces that adhere to each of the longitudinal slats.

6. The display device of claim 1 further comprising a support stand attachable to the assembly of slats and spool pieces.

7. The display device of claim 5 where the substantially circular display surfaces are images of baseballs.

8. The display device of claim 5 where the substantially circular display surfaces are adapted horizontally to support displays.

9. A baseball theme display device comprising:

a wooden baseball bat having a barrel end and a narrower handle end where a portion of the bat adjacent to and including the barrel end has been sawed into a plurality of longitudinal slats, each sawed slat having a barrel end and a handle end with a hole located in the handle end and each slat being configured to horizontally support a display by sitting upon the slat, and the remainder of the bat having been separated into a plurality of spool pieces, each said spool piece having a longitudinal passageway, and a longitudinal assembly rod, wherein the display device is configured so that the assembly rod passes alternately through the holes in the slats and the longitudinal passageways in said spool pieces.

10. The display device of claim 9 where the assembly rod is threaded and further comprising fasteners configured to hold the display device together.

11. The display device of claim 9 where the slats are rotatable about the assembly rod.

12. The display device of claim 9 further comprising at least one opening adapted to allow the display device to be hung.

13. The display device of claim 9 further comprising substantially circular display surfaces that adhere to each of the longitudinal slats.

14. The display device of claim 9 further comprising a support stand attachable to the assembly of slats and spool pieces.

15. The display device of claim 13 where the substantially circular display surfaces are images of baseballs.

16. The display device of claim 13 where the substantially circular display surfaces are adapted horizontally to support displays.

17. A baseball theme display device comprising:

a plurality of sawed longitudinal parts longitudinally sawed from a wooden baseball bat, the sawed longitudinal parts being wider than they are thick, each sawed longitudinal part having a barrel end and a narrower handle end corresponding to a barrel end and a narrower handle end of the wooden baseball bat, each sawed longitudinal part having a hole located in the handle end, a plurality of spool pieces with longitudinal passageways sawed from the handle end of the wooden baseball bat, and a longitudinal assembly rod, wherein the display is configured so that the assembly rod passes alternately through the holes in the sawed longitudinal parts and the longitudinal passageways in the spool pieces, such that the sawed longitudinal parts are separated from each other on the longitudinal assembly rod by a spool piece.

18. The display device of claim 17 where the assembly rod is threaded and further comprising fasteners configured to hold the display device together.

19. The display device of claim 17 where the sawed longitudinal parts are rotatable about the assembly rod and the holes located in the handle ends of the sawed longitudinal parts.

20. The display device of claim 17 further comprising at least one opening adapted to allow the display device to be hung.

21. The display device of claim 17 further comprising substantially circular display surfaces adherent to each of the sawed longitudinal parts.

22. The display device of claim 17 further comprising a support stand attachable to the assembly of the sawed longitudinal parts and spool pieces.

23. The display device of claim 21 where the substantially circular display surfaces are images of baseballs.

24. The display device of claim 21 where the substantially circular display surfaces are adapted horizontally to support displays.

* * * * *